United States Patent [19]

Gunter

[11] Patent Number: 5,031,601

[45] Date of Patent: Jul. 16, 1991

[54] ARROW SUPPORT

[75] Inventor: Lester M. Gunter, Seminole, Okla.

[73] Assignee: William M. Hooten, Seminole, Okla.

[21] Appl. No.: 571,487

[22] Filed: Aug. 22, 1990

[51] Int. Cl.[5] ..... F41B 5/00

[52] U.S. Cl. ..... 124/44.5; 124/24.1

[58] Field of Search ..... 124/44.5, 24.1, 23.1, 124/25.6, 88

[56] References Cited

U.S. PATENT DOCUMENTS

| | | | |
|---|---|---|---|
| 2,998,811 | 9/1961 | Sackmann | 124/24.1 |
| 3,108,584 | 10/1963 | Coe | 124/24.1 |
| 3,406,675 | 10/1968 | Fredrickson | 124/25.7 |
| 3,504,659 | 4/1970 | Babington | 124/24.1 |
| 4,236,497 | 12/1980 | Troncoso, Jr. | 124/24.1 |
| 4,324,221 | 4/1982 | Peck | 124/24.1 |
| 4,332,232 | 6/1982 | Troncoso, Jr. | 124/24.1 |
| 4,598,688 | 7/1986 | Paul et al. | 124/44.5 |
| 4,756,295 | 7/1988 | Guzzetta | 124/24.1 X |
| 4,791,907 | 12/1988 | Corley | 124/24.1 X |

*Primary Examiner*—Peter M. Cuomo
*Assistant Examiner*—Jeffrey L. Thompson
*Attorney, Agent, or Firm*—Dunlap, Codding, Peterson & Lee

[57] ABSTRACT

An arrow support for use with a bow having a bow string and an arrow having an arrow shaft, a nock and fletch. The arrow support includes a support base connected to the bow. A first and a second post each are connected to the support base. A first roller arm is connected to the first post and the first roller arm extends at an angle upwardly from the base a distance from the first post generally toward the second post. A second roller arm is connected to the second post and the second roller arm extends a distance generally upwardly from the base and generally toward the first post. A roller is rollingly connected to the first roller arm and a second roller is rollingly connected to the second roller arm. The first and the second rollers each extend a distance from the respective first and the second roller arms for forming first and second roller contact surfaces. The arrow support is positioned on the bow so that the arrow shaft is supported on the first and the second roller contact surfaces as the arrow is being discharged from the bow. The first and the second post cooperate with the first and the second roller arms and the upper surface of the base to form a fletch channel for accommodating the fletch of the arrow as the arrow is rollingly discharged over the first and the second roller contact surfaces. The first and the second roller arms each extend at an angle from the respective first and second posts in a range from about 55° to about 65° with the angles each being preferably about 60°.

9 Claims, 3 Drawing Sheets

ARROW SUPPORT

FIELD OF THE INVENTION

The present invention relates generally to arrow supports and, more particularly, but not by way of limitation, to an arrow support having a first and a second roller supported on respective first and the second roller arms wherein the first and the second rollers rollingly engage the arrow shaft as the arrow is being discharged from the bow with the first and the second roller arms each extending at an angle from respective first and the second posts in a range from about 55° to about 65° and preferably at an angle of about 60°.

BRIEF DESCRIPTION OF THE DRAWINGS

FIG. 6 is a side elevational view of the arrow support of FIG. 2, showing the side opposite the side shown in FIG. 5.

DESCRIPTION OF THE PREFERRED EMBODIMENTS

Figure 1:
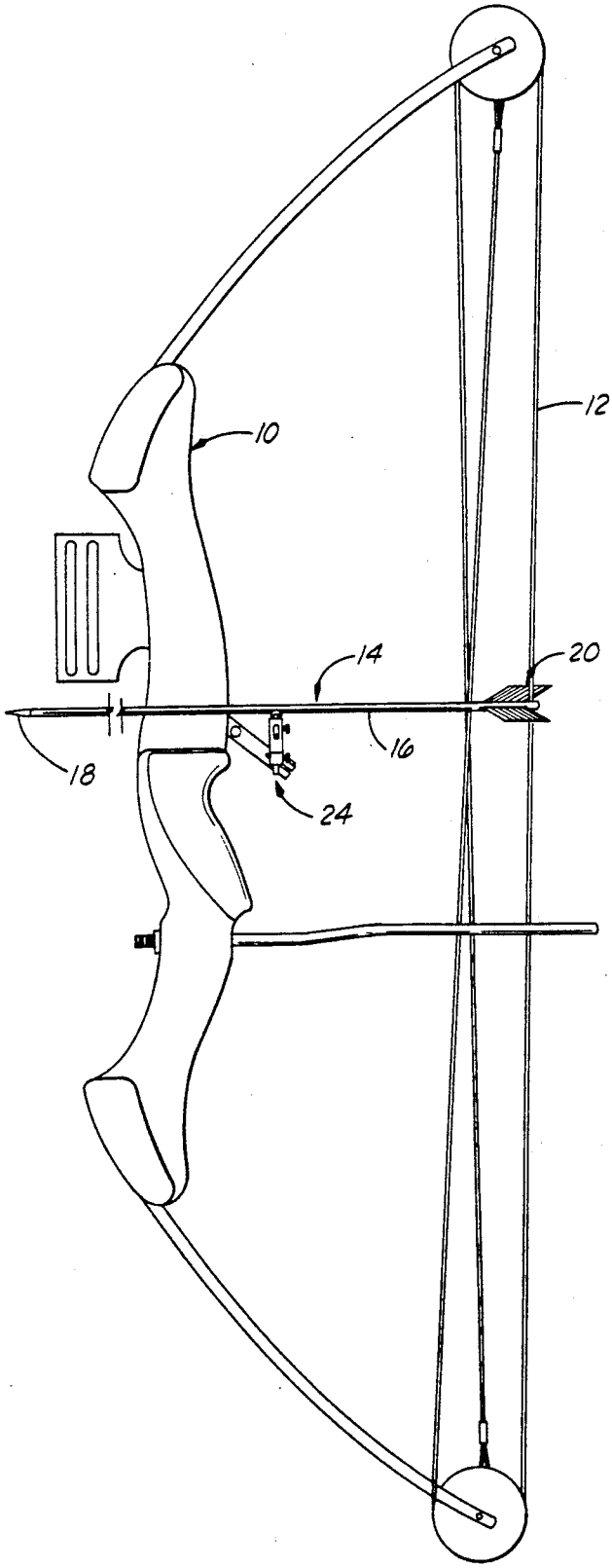
FIG. 1 is a side elevational view diagrammatically showing a typical bow having an arrow support constructed in accordance with the present invention connected thereto and showing an arrow operatively connected to the bow and supported on the arrow shaft.
Figure 2:
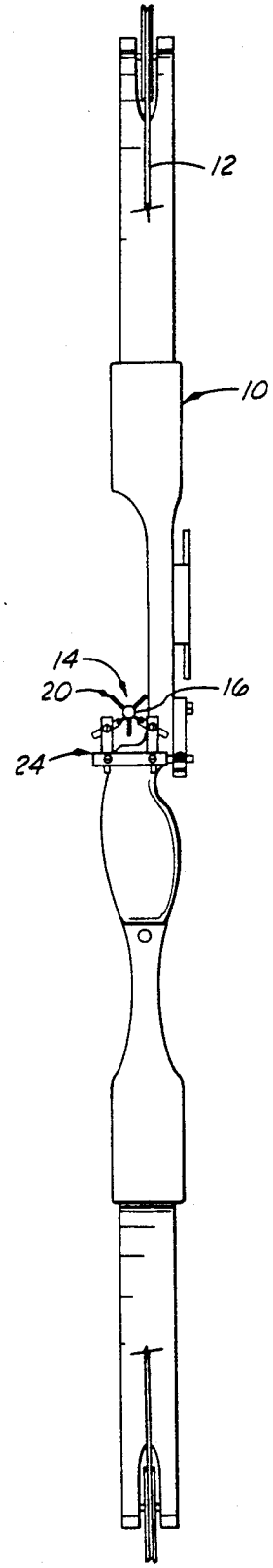
FIG. 2 is a rear elevational view of the bow and arrow support of FIG. 1.

Shown in FIGS. 1 and 2 is a bow 10 having a bow string 12. The bow 10 diagrammatically shown in FIGS. 1 and 2 more particularly is of the type commonly referred to as a compound bow. However, it should be noted that the present invention is adapted to be used with any bow and the present invention is not limited to any particular bow such as the compound bow diagrammatically shown in FIGS. 1 and 2. Also, shown in FIGS. 1 and 2 is an arrow 14 having an arrow shaft 16 with an arrow point 18 formed on one end thereof and a fletch 20 formed on an opposite end thereof with a nock (not shown) being formed on the end of the arrow 14 having the fletch 20 disposed thereon. In operation, the bow string 12 is disposed in the nock of the arrow 14 and bow string is drawn away from the bow 10 to a position wherein the bow string 12 is released thereby discharging the arrow 14 from the bow in a manner well known in the art.

It should be noted that the term "fletch" as used herein in connection with the fletch 20 is intended to encompass all types of fletches such as feathers or plastic veins for example and the term "fletch" is not intended to be limited to any particular construction or material of construction. Further, the fletch 20 may be a straight fletch or a helical fletch depending upon the application or the desires of the shooter.

When the arrow 14 is discharged from the bow 10, it is important that the arrow 14 not oscillate or move up and down as the arrow 14 travels toward the target. Such oscillation causes the arrow to deviate from the desired path. Such oscillations also result in noise which is undesirable particularly when the bow 10 and arrow 14 are used in hunting situations. The present invention consist of an arrow support 24 which is connected to the bow 10 and adapted to stabilize the flight of the arrow 14 and reduce or substantially eliminate oscillations in the arrow 14 as it travels on its flight path after being released from the bow 10.

The arrow support 24 of the present invention is shown in more detail in FIGS. 3, 4, 5 and 6. The arrow support 24 basically comprises a support base 26 having a first and a second post 28 and 30 connected thereto with a first roller support arm 32 being connected to the first post 28 and a second support roller arm 34 being connected to the second post 30.

Figure 3:
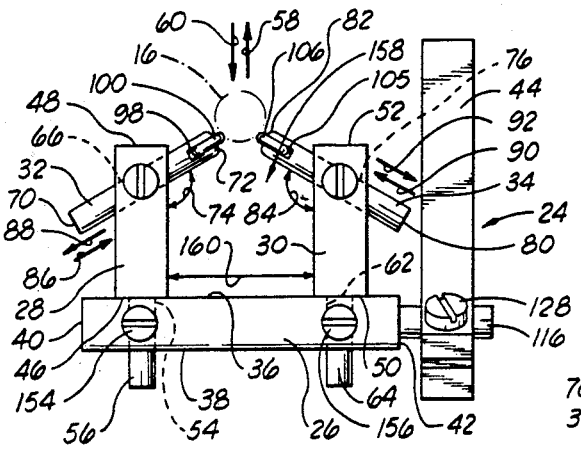
FIG. 3 is a rear elevational view of the arrow support shown in FIGS. 1 and 2.
Figure 4:
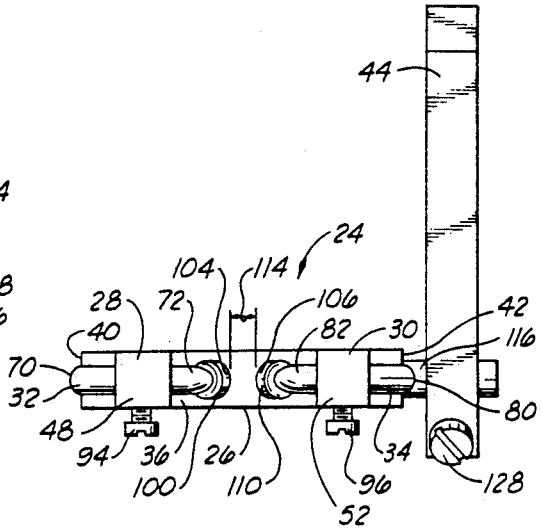
FIG. 4 is a top plan view of the arrow support of FIG. 3.
Figure 5:
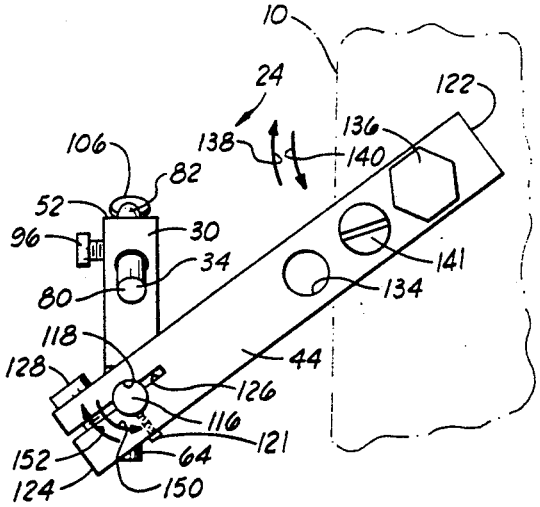
FIG. 5 is a side elevational view of the arrow support of FIG. 2.
Figure 5:
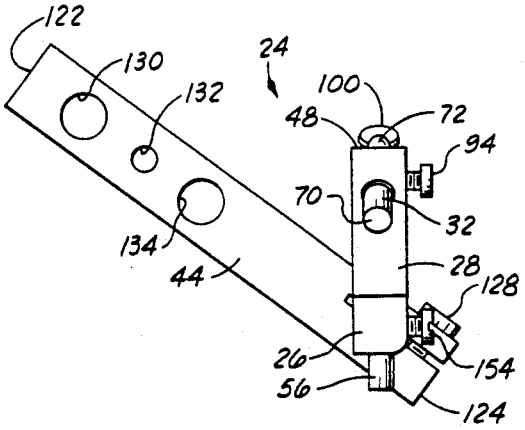

The support base 26 has an upper surface 36 (FIGS. 3 and 4), a lower surface 38 (FIG. 3), a first end 40 (FIGS. 3 and 4) and a second end 42 (FIGS. 3 and 4). The second end 42 of the support base 26 is pivotally connected to a support arm 44. The support arm 44 is pivotally connected to the bow 10.

The first post 28 has a first end 46 and a second end 48. The first end 46 of the first post 28 is connected to the upper surface 36 of the support base 26. The first post 28 is disposed near the first end 40 of the support base 28. The first post 28 extends a distance generally upwardly from the upper surface 36 of the support base 26 terminating with the second end 48 of the first post 28. The first post 28 extends generally perpendicularly upwardly from the upper surface 36 of the support base 26.

The second post 30 has a first end 50 and a second end 52. The first end 50 of the second post 30 is connected to the upper surface 36 of the support base 26. The second post 30 is disposed near the second end 42 of the support base 26. The second post 30 extends a distance generally upwardly from the upper surface 36 of the support base 26 terminating with the second end 52 of the second post 30. The second post 30 extends generally perpendicularly upwardly from the upper surface 36 of the support base 26.

An opening 54 (FIG. 3) is formed through the support base 26 generally near and spaced a distance from the first end 40 of the support base 26. The opening 54 intersects the upper and lower surfaces 36 and 38 of the support base 26. The first post 28 more particularly has a post rod 56 connected to the first end 46 of the first post 28 and the post rod 56 extends a distance from the first post 28. The post rod 56 is slidingly disposed in the opening 54 so that the first post 28 is movable in an upwardly direction 58 and a downward direction 60 on the support base 26 for reasons which will be made more apparent below.

An opening 62 (FIG. 3) is formed through the support base 26 generally near and spaced a distance from the first end 40 of the support base 26. The opening 62 intersects the upper and lower surfaces 36 and 38 of the support base 26. The second post 30 more particularly has a post rod 64 connected to the first end 56 of the second post 30 and the post rod 64 extends a distance from the second post 30. The post rod 64 is slidingly disposed in the opening 62 so that the second post 30 is movable in the upwardly direction 58 and the downward direction 60 on the support base 26 for reasons which will be made more apparent below.

An opening 66 (FIG. 3) is formed through the first post 28 generally near the second end 48. The opening 66 extends angularly through the first post 28 and intersects the opposite faces or sides of the first post 28. The first roller support arm 32 is slidingly disposed in the opening 66 in the first post 28. The first roller support arm 32 has a first end 70 and a second end 72. More particularly, a portion of the first roller support arm 32 generally near the end 70 is slidingly disposed in the opening 66. The opening 66 and the first roller support arm 32 each are disposed near and spaced a distance from the second end 48 of the first post 28. The first roller support arm 32 extends a distance angularly from the first post 28 at an angle 74, the first roller support arm extending generally upwardly from the upper surface 36 of the support base 28.

An opening 76 (FIG. 3) is formed through the second post 30 generally near the second end 52. The opening 76 extends angularly through the second post 30 and intersects the opposite faces or sides of the second post 30. The second roller support arm 34 is slidingly disposed in the opening 76 in the second post 30. The second roller support arm 34 has a first end 80 and a second end 82. More particularly, a portion of the second roller support arm 34 generally near the end 80 is slidingly disposed in the opening 76. The opening 76 and the second roller support arm 34 each are disposed near and spaced a distance from the second end 52 of the second post 30. The second roller support arm 34 extends a distance angularly from the second post 30 at an angle 84 (FIG. 3), the second roller support arm 34 extending generally upwardly from the upper surface 36 of the support base 28.

The first roller support arm 32 is slidingly disposed in the opening 66 for sliding movement in one direction 86 generally away from the first post 28 and in an opposite direction 88 generally toward the first post 28. The second roller support arm 34 is slidingly disposed in the opening 76 for movement in one direction 90 generally away from the second post 30 and in an opposite direction 92 generally toward the second post 30 for reasons which will be made more apparent below.

The first roller support arm 32 is secured in the opening 66 via set screw 94 (FIGS. 4 and 6) which extends through portions of the first post 28 and engages the first roller support arm 32. The second roller support arm 34 is secured in the opening 76 via set screw 96 (FIGS. 4 and 5) which extends through portion of the second post 30 and engages the second roller support arm 34.

A recess 98 (FIG. 3) is formed in the second end 72 of the first roller support arm 32. A plastic first roller 100 is disposed in the recess 98. The first roller 100 is rollingly supported on the first roller support arm 68 via a pivot shaft (not shown) which is connected to the first roller support arm 32. A portion of the first roller 100 extends beyond the second end 72 of the first roller support arm 68 forming a first roller contact surface 104 (FIG. 4).

A recess 105 (FIG. 3) is formed in the second end 72 of the second roller support arm 34. A plastic second roller 106 is disposed in the recess 105. The second roller 106 is rollingly supported on the second roller support arm 34 via a pivot shaft (not shown) which is connected to the second roller support arm 34. A portion of the second roller 106 extends beyond the second end 82 of the second roller support arm 34 forming a second roller contact 110 (FIG. 4).

The first roller support arm 32 extends at an angle of about 120° to the second roller support arm 34. More particularly, the first roller 100 is disposed at the angle of about 120° with respect to the second roller 106 with the center of the arrow shaft 16 being disposed generally midway or in the center of that 120° angle. The first roller 100 is spaced a distance 114 (FIG. 4) from the second roller 106. The first roller support arm 32 and the second roller support arm 98 are adjusted within the respective first and the second posts 28 and 30 so that the distance 114 is slightly less than the diameter of the arrow shaft 16. The first and second roller support arms 32 and 98 are adjusted so that the ends 72 and 82 are disposed in a common horizontal plane and so the rollers 100 and 106 roll on the shaft 16 as the shaft 16 passes over the roller contact surfaces 104 and 110.

An opening 118 (FIG. 5) is formed through the support arm 44. The support arm 44 has a first end 122 and a second end 124. The opening 118 more particularly is disposed near and spaced a distance from the second end 124. One end of the base shaft 116 extends through the opening 118. A slot 126 is formed in the support arm 44 and the slot 126 extends a distance through the upper arm intersecting the second end 124 of the support arm 44. The slot 126 intersects the opening 118. A set screw 128 is disposed through the support arm 44 with the set screw 128 extending through the support arm 44 and intersecting the slot 126 for widening and closing the slot 126 in a manner and for reasons to be made more apparent below. A set screw 121 (FIG. 5) is disposed through a portion of the support arm 44 and into engagement with the base shaft 116 for locking the base shift 116 in position.

Three holes 130, 132 and 134 are formed through the support arm 44 generally near and spaced a distance from the first end 122 of the support arm 44. One of the holes 130 or 134 is aligned with a hole (not shown) in the bow 10 and a fastener 136 (FIG. 5) is disposed through the hole 130 or 134 aligned with the hole (not shown) in the bow for securing the support arm 44 to the bow 10. The support arm 44 is pivotal about the fastener 136 in one direction 138 (FIG. 5) and in an opposite direction 140 (FIG. 5) when the fastener 136 is loosened. The fastener 136 is tighten against the bow 10 to secure the support arm 44 in one set position, and a fastener 141 (FIG. 5) is disposed through the opening 132 and threaded into engagement with the bow 10 to lock the support arm 44 in the set position.

Figure 7:
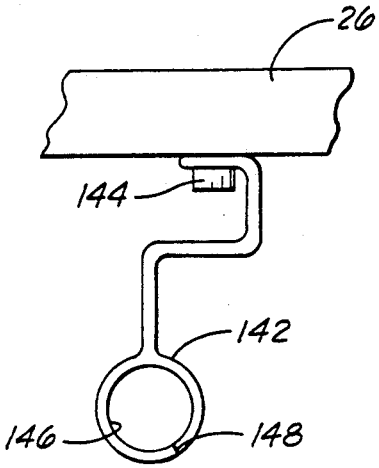
FIG. 7 is a side elevational view showing a fragment of the support base of the arrow support with an arrow holder attached thereto.

As shown in FIG. 7, an arrow holder 142 is connected to the support base 26 via a fastener 144. An arrow opening 146 is disposed through the arrow holder 142 and a slit 148 is formed through the arrow holder 142 intersecting the arrow opening 146. The arrow holder 142 is constructed of a relatively flexible material such as a rubber material for example.

In use, the arrow shaft 16 is disposed through the arrow opening 146 in the arrow holder 142 while the arrow is supported on the first and second rollers 100 and 106. When the bow string 12 and arrow 14 are drawn, the arrow 14 is released from the arrow holder 142 via the slit 148.

In operation, the support arm 44 initially is secured to the bow 10 by way of the fastener 136. The bow support arm 44 is adjusted in the directions 138 and 140 to position the arrow support 24 in a proper orientation with respect to the bow 10. The fastener 136 then is secured or tightened to fix the support arm 44 in the adjusted position.

The set screw 128 is loosened and the support base 26 is rotated in the opening 118 in a direction 150 (FIG. 5) and/or a direction 152 (FIG. 5) to orient the first and the second posts 28 and 30 in a position extending generally parallel with the bow and to orient the first and the second rollers 100 and 106 in a proper position for supporting the arrow 14. The set screw 128 then is tighten to close the slot 126 thereby tightening the support arm 44 about the base shaft 116 to secure the support base 26 in the adjusted orientation.

The first and the second posts 28 and 30 then may be moved in the upwardly or downwardly directions 58 and 60 to properly position the first and the second rollers 100 and 106 for supporting the arrow 14. When the first and the second posts 28 and 30 have been properly positioned, a fastener 154 (FIG. 3) is threaded through the support base 26 and into engagement with the post rod 56 for securing the first post 28 in the adjusted position and a fastener 156 (FIG. 3) is threaded through the support base 26 and into engagement with the post rod 64 for securing the second post 30 in the adjusted position.

The first and the second roller support arm 32 and 34 are moved in the directions 86, 88, 90 or 92 respectively to properly position the first and the second rollers 100 and 106 in a proper position for supporting the arrow 14 wherein the first and the second rollers 100 and 106 are spaced the distance 114 apart, a distance which is slightly less than the diameter of the arrow 14. When the first and the second roller support arm 68 and 78 have been positioned properly, set screw 94 is tighten to secure the first roller support arm in the adjusted position and the set screw 96 is tightened to fix the second roller support arm 78 in the adjusted position.

The first and the second post 28 and 30 are spaced a distance 160 apart and the first and the second roller support arms 32 and 34 are supported generally above the upper surface 36 and the support base 26 for forming a fletch channel 158.

The shooter or operator then places the bow string 12 in the nock of the arrow 14 and a portion of the arrows shaft 16 is positioned and supported generally on the first and the second roller contact surfaces 104 and 110 of the first and the second rollers 100 and 106, respectively. The operator then draws the bow string 12 with the arrow 14 removably connected thereto and releases the bow string 12 for discharging or shooting the arrow 14. As the arrow shaft 16 is moved in one direction as the bow 10 is drawn, the first and the second roller contact surfaces 104 and 110 of the first and the second rollers 100 and 106, respectively, rollingly engage the arrow shaft 16. When the bow string 12 is released and as arrow 14 is being discharged from the bow 10, the arrow shaft 16 rollingly engages the first and the second roller contact surfaces 104 and 110 of the first and the second rollers 100 and 106, respectively. This rolling engagement with the arrow shaft 16 provided by the first and the second rollers 100 and 106 cooperates to stabilize the arrow 14 and prevent oscillations of the arrow 14 as the arrow 14 is being discharged or shot from the bow 10.

As the fletch 20 passes the arrow support 24, a portion of the fletch 20 is disposed generally above the arrow support 24 and the remaining portion of the fletch 20 passes through the fletch channel 158. The fletch channel 158 is sized to accommodate a portion of the fletch 20 of the arrow 14 as the arrow 14 is rollingly discharged over the first and the second roller contact surfaces 104 and 110.

Figure 8:
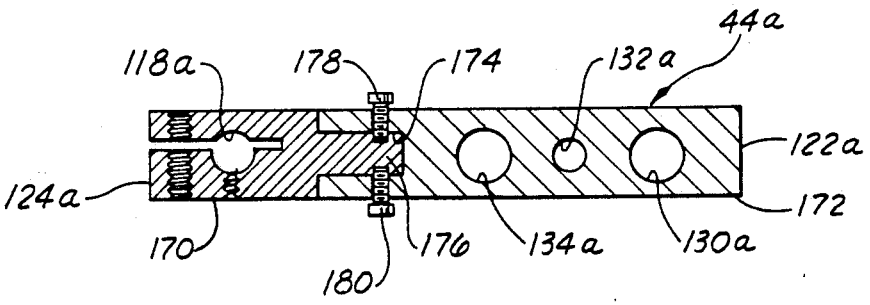
FIG. 8 is a side elevational, partial sectional view of a modified support arm which may be used with the arrow support of the present invention in lieu of the support arm shown in FIGS. 1-6.
Figure 9:
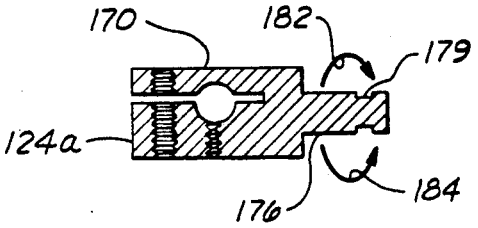
FIG. 9 is a side elevational view showing a portion of the support arm shown in FIG. 8.

Shown in FIGS. 8 and 9 is a modified support arm **44*a* which may be used in lieu of the support arm 44 described in detail before. The modified support arm 44*a* is constructed exactly like the support arm 44, except the modified support arm 44*a* includes a first arm 170 and a second arm 172. A cylindrically shaped opening 174 is formed into one end of the second arm 172. A cylindrically shaped arm post 176 is formed on one end of the first arm 170. A recess 179 is formed in the arm post 176 and the recess 179 extends circumferentially about the arm post 176**.

The arm post 176 is disposed in the recess 174. A pair of fasteners 178 and 180 each extend through a portion of the second arm 172 and a portion of each of the fasteners 178 and 180 is disposed in the recess 179 of the arm post 176. The fasteners 178 and 180 cooperate to connect the first arm 170 to the second arm 172.

In operation, the fasteners 178 and 180 are loosen and the first arm 170 is rotated in a direction 182 or a direction 184 to rotationally adjust the position of the first arm 170 with respect to the second arm 172 thereby rotationally positioning the support base 26. This additional adjustment feature may be desired in some applications of the arrow support of the present invention.

Changes may be made in the construction and the operation of the various components, parts, elements and assemblies of the arrow support described herein without departing from the spirit and scope of the invention as defined in the following claims.

What is claimed is:

1. An arrow support for use with a bow having a bow string and an arrow having an arrow shaft with a diameter, a nock and a fletch, comprising:

a support base having an upper surface, a lower surface, a first end and a second end;

a first post having a first end and a second end, the first end of the first post being connected to the upper surface of the support base and the first post extending a distance generally upwardly from the upper surface of the support base terminating with the second end thereof;

a second post having a first end and a second end, the first end of the second post being connected to the upper surface of the support base and the second post extending a distance generally upwardly from the upper surface of the support base terminating with the second end thereof, the second post being spaced a distance from the first post;

a first roller support arm having a first end and a second end, the roller support arm being connected to the first post at a position near the second end of the first post and the first roller support arm extending a distance from the first post at an angle upwardly from the upper surface of the support base and toward the second post;

a first roller rollingly connected to the second end of the first post with a portion of the first roller extending a distance from the second end of the first post forming a first roller contact surface;

a second roller support arm having a first end and a second end, the second roller support arm being connected to the second post at a position near the second end of the second post and the second roller support arm extending a distance from the second post at an angle upwardly from the upper surface of the base and toward the second post;

a second roller rollingly connected to the second end of the second roller support arm with a portion of the second roller extending a distance from the second end of the second roller support arm forming a second roller contact surface, the first roller support arm being positioned with respect to the second roller support arm and that the first roller is spaced a distance from the second roller slightly less than the diameter of the arrow shaft and the first and the second rollers being positioned for rollingly supporting a portion of the arrow shaft with the arrow shaft being rollingly supported on the first and the second roller contact surfaces of the first and the second rollers respectively;

means for connecting the support base to the bow whereby the arrow shaft is supportable on the first and the second roller contact surfaces when the nock of the arrow is engaged in the bow string and the first and the second roller contact surfaces rollingly engaging the arrow shaft when the bow string is released and as the arrow is discharged from the bow, the first and the second roller arms being spaced a distance from the upper surface of the support base and cooperating with the distance between the first and the second posts and the upper surface of the support base to form a fletch channel whereby the fletch channel is sized to accommodate a portion of the fletch of the arrow as the arrow is rollingly discharged over the first and the second roller contact surfaces.

2. The arrow support of claim 1 wherein the first roller arm extends from the first post at an angle in a range from about 55° to about 65°, and wherein the second roller support arm extends at an angle from the second post in a range from about 55° to about 65°.

3. The arrow support of claim 1 wherein the first roller support arm extends at an angle of about 60° from the first post, and wherein the second roller support arm extends at an angle of about 60° from the second post.

4. The arrow support of claim 1 wherein the first post has an opening formed therethrough and wherein a portion of the first roller support arm near the first end thereof is slidingly disposed in the opening in the first post for moving the first roller support arm in one direction generally away from the first post and in an opposite direction generally toward the first post for adjusting the position of the first roller support arm in the first post;

means for securing the first roller support arm in one position in the opening in the first post; wherein the second post has an opening formed therethrough and wherein a portion of the second roller support arm generally near the first end thereof is slidingly supported in the opening in the first post for sliding movement in one direction generally away from the second post and for sliding movement in an opposite direction generally toward the first post; and means for securing the second roller support arm in one position in the opening in the second post.

5. The arrow support of claim 1 wherein the support base has an opening extending therethrough intersecting the upper and the lower surfaces thereof and disposed generally near the first end and another opening formed therethrough and intersecting the upper and the lower surfaces thereof disposed generally near the second end and wherein the arrow support further comprises:

a first post rod having one end connected to the first end of the first post, the first post rod being slidingly disposed through the opening in the support base generally near the first end of the support base whereby the first post is movable in one direction generally away from the upper surface of the support base and in an opposite direction generally toward the upper surface of the support base; and a second post rod having opposite ends with one end of the second post rod being connected to the first end of the second post, the second post rod being slidingly disposed in the opening formed in the support base near the second end of the support base whereby the second post is movable in one direction generally away from the upper surface of the support base and in an opposite direction generally toward the upper surface of the support base;

fastener means connected to the support base and engageable with a portion of the first post rod for securing the first post in one position with respect to the support base; and fastener means connected to the support base and engageable with a portion of the second post rod for securing the second post in one position with respect to the support base.

6. The apparatus of claim 1 wherein the means for connecting the support base to the bow further comprises:

a support arm having a first end and a second end and an opening being formed through a portion of the support arm generally near the second end thereof;

a base shaft having opposite ends, one end of the base shaft being connected to the second end of the support base and the base shaft extending a distance from the second end of the support base and being disposed through the opening formed in the support arm generally near the second end of the support arm whereby the base shaft and the support base connected thereto is rotationally movable in one direction and rotationally movable in an opposite direction for adjustingly positioning the support base with respect to the support arm; and means for fastening the base shaft in one position in the opening in the support arm.

7. The arrow support of claim 6 wherein the support arm includes a series of holes formed therethrough and disposed generally near the first end of the support arm; and fastening means disposable through one of the series of holes in the support arm with a portion of the fastener means being connectingly engageable with a portion of the bow for connecting the support arm to the bow, the support arm being movable about said fastener means in one direction and in an opposite direction for adjusting the position of the support arm with respect to the bow and the fastener means being movable to a fastened position for securing the support arm in one fixed position with respect to the bow.

8. The arrow support of claim 1 further comprising:

an arrow holder connected to the support base having an arrow opening formed through a portion thereof sized to receive a portion of the arrow shaft and a slit formed through a portion of the arrow holder intersecting a portion of the arrow hole, the arrow shaft being disposable through the arrow opening in the arrow holder when the arrow shaft is supported on the first and the second roller and the arrow being released from the arrow holder via the slit in the arrow holder when the arrow is drawn.

9. The apparatus of claim 1 wherein the means for connecting the support base to the bow further comprises:

a support arm having a first end and a second end, the support base being connected to the support arm generally near the second end thereof, the support arm comprising:

a first arm having opposite ends;

an arm post connected to one end of the first arm, the arm post being generally cylindrically shaped and having a recess formed in a portion thereof and extending circumferentially thereabout;

a second arm having opposite ends with a cylindrically shaped opening being formed through one end thereof, the arm post of the first arm being disposable in the opening in the second arm whereby the first arm is rotationally movable in one direction and rotationally movable in an opposite direction for adjusting the position of the first arm with respect to the second arm; and means for securing the first arm in one position with respect to the second arm.

* * * * *